US008973316B2

(12) United States Patent
Safford

(10) Patent No.: US 8,973,316 B2
(45) Date of Patent: Mar. 10, 2015

(54) SECTIONAL CONSTRUCTION ASSEMBLIES

(76) Inventor: Franz Safford, Red Hook, NY (US)

( * ) Notice: Subject to any disclaimer, the term of this patent is extended or adjusted under 35 U.S.C. 154(b) by 885 days.

(21) Appl. No.: 11/283,418

(22) Filed: Nov. 17, 2005

(65) Prior Publication Data

US 2007/0094955 A1 May 3, 2007

Related U.S. Application Data

(60) Provisional application No. 60/724,996, filed on Oct. 7, 2005.

(51) Int. Cl.
*E04B 2/88* (2006.01)
*E04B 2/96* (2006.01)
*E06B 3/54* (2006.01)

(52) U.S. Cl.
CPC . *E04B 2/96* (2013.01); *E04B 2/885* (2013.01); *E06B 3/5427* (2013.01)
USPC ..... 52/204.62; 52/235; 52/710

(58) Field of Classification Search
USPC ..... 52/204.7, 204.5, 204.65, 204.68, 52/204.71, 204.72, 235, 710; 403/387; 248/225.11, 241, 244, 245, 295.11, 248/297.21; 211/94.01, 103, 207
See application file for complete search history.

(56) References Cited

U.S. PATENT DOCUMENTS

| | | | | | |
|---|---|---|---|---|---|
| 2,345,650 | A | * | 4/1944 | Attwood | 403/21 |
| 2,996,845 | A | | 8/1961 | Cipriani et al. | |
| 3,052,330 | A | | 9/1962 | Hammitt et al. | |
| 3,053,353 | A | * | 9/1962 | Miller | 52/477 |
| 3,266,209 | A | * | 8/1966 | Zibell | 52/665 |
| 3,321,880 | A | | 5/1967 | Ferrell | |
| 3,548,558 | A | | 12/1970 | Grossman | |
| 3,561,182 | A | | 2/1971 | Madl, Jr. | |
| 3,813,120 | A | * | 5/1974 | Kelly | 292/251 |
| 3,938,297 | A | * | 2/1976 | Sato et al. | 403/188 |
| 4,031,680 | A | | 6/1977 | Stoakes | |
| 4,469,198 | A | * | 9/1984 | Crump | 182/141 |
| 4,500,572 | A | | 2/1985 | Francis | |
| 4,560,130 | A | * | 12/1985 | Schwartz | 248/297.21 |
| 4,568,050 | A | * | 2/1986 | Radoy et al. | 248/223.41 |
| 4,680,905 | A | * | 7/1987 | Rockar | 52/200 |
| 4,784,552 | A | * | 11/1988 | Rebentisch | 411/85 |
| 4,873,805 | A | * | 10/1989 | Ting | 52/235 |
| 4,873,806 | A | * | 10/1989 | Jeschke | 52/235 |
| 4,895,331 | A | * | 1/1990 | Nehls | 248/245 |
| 4,948,313 | A | * | 8/1990 | Zankovich | 411/85 |
| 5,154,385 | A | * | 10/1992 | Lindberg et al. | 248/225.11 |
| 5,481,839 | A | | 1/1996 | Lang et al. | |
| 5,833,417 | A | * | 11/1998 | Sargent et al. | 411/85 |

(Continued)

FOREIGN PATENT DOCUMENTS

| | | | |
|---|---|---|---|
| FR | 2585391 | A1 | 1/1987 |
| WO | 95/13439 | A1 | 5/1995 |
| WO | 00/45020 | A1 | 8/2000 |

*Primary Examiner* — Andrew J Triggs
(74) *Attorney, Agent, or Firm* — The Noblitt Group, PLLC

(57) ABSTRACT

The disclosed system, method and device for construction generally includes a mullion having a guide track disposed therein and a custom fitting suitably adapted to support a construction section via substantially adjustable attachment to the guide track. Disclosed features and specifications may be optionally controlled, adapted or otherwise modified to improve the retention and/or support of construction sections in a variety of operating environments. Exemplary embodiments of the present invention generally provide improved aesthetic presentation and mechanical retention of construction panels in point-supported glass wall systems.

22 Claims, 14 Drawing Sheets

(56) References Cited

U.S. PATENT DOCUMENTS

| | | | | | |
|---|---|---|---|---|---|
| 5,839,236 | A * | 11/1998 | Frey | 52/235 |
| RE36,681 | E * | 5/2000 | Rinderer | 411/85 |
| 6,086,300 | A * | 7/2000 | Frohlich | 411/84 |
| 6,105,794 | A * | 8/2000 | Bauer | 211/94.01 |
| 6,401,410 | B2 * | 6/2002 | Kenny et al. | 52/235 |
| 6,484,465 | B2 * | 11/2002 | Higgins | 52/474 |
| 6,588,711 | B2 * | 7/2003 | Onishi | 248/49 |
| 6,598,361 | B2 * | 7/2003 | Ting | 52/235 |
| 6,827,320 | B2 * | 12/2004 | Yeh | 248/220.22 |
| 7,234,566 | B2 * | 6/2007 | Simmons | 187/408 |
| 7,716,891 | B2 * | 5/2010 | Radford | 52/506.08 |
| 2002/0124514 | A1 * | 9/2002 | Higgins | 52/506.06 |
| 2004/0025459 | A1 * | 2/2004 | Huebner et al. | 52/282.1 |
| 2004/0221526 | A1 * | 11/2004 | Rinehart et al. | 52/204.62 |
| 2005/0284053 | A1 * | 12/2005 | Grunewald et al. | 52/235 |
| 2006/0123722 | A1 * | 6/2006 | Stenvall | 52/235 |
| 2007/0194191 | A1 * | 8/2007 | Persson | 248/225.11 |

* cited by examiner

SECTIONAL CONSTRUCTION ASSEMBLIES

RELATED APPLICATIONS

This application claims priority to U.S. Provisional Patent Application Ser. No. 60/724,996 filed in the United States Patent and Trademark Office on Oct. 7, 2005 by Franz Safford.

FIELD OF INVENTION

The present invention generally concerns systems and methods for assembling construction sections; and more particularly, representative and exemplary embodiments of the present invention generally relate to assembly and construction of glass panel walls.

BACKGROUND OF INVENTION

A variety of systems are used in the construction of buildings. Many of these systems employ a framework, such as in the case of conventional point-supported and conventional glass wall systems. In these systems, panes of glass are attached to, and supported by, an aluminum framework; however, such systems suffer from substantial drawbacks.

One problem presented by conventional glass wall systems is the need for significant structure to support the panes of glass. Existing systems often require both horizontal and vertical support members in order to provide structural integrity for retaining panes of glass making up the wall. Implementing such an extensive framework is often costly due, at least in part, to the amount of construction material required and the time needed to build the framework. Additionally, horizontal and vertical supports generally are connected together in a substantially unitary manner, and such restriction often limits architectural design options for an engineer or architect employing such a system. As a result, conventional glass wall systems have been constrained to substantially orthogonal frameworks.

Another problem involves the difficulty associated with constructing conventional point-support frameworks. For example, some systems require holes to be drilled in the glass panes in order to permit bolts to be inserted to attach the glass panels to the support structure. In generally, these holes typically are drilled with a relatively high degree of precision, or the pane of glass may not properly fit within the structure. Moreover, holes in the glass panels general present additional problems associated with sealing the glass wall from the exterior environment. Thus, the time and skill required to drill holes in the glass panes and mount the panes on existing framing systems becomes a substantial portion of the overall cost of implementing conventional point-supported glass wall systems.

The amount of structural support typically required in conventional glass wall systems also exacts a toll on the aesthetic properties of the framework system. While a glass wall with fewer supporting elements may give the appearance of a wall made nearly entirely of glass, the volume of columns, beams and other structural elements typically found in conventional point-supported glass walls often detract from their appearance and overall aesthetic appeal. Accordingly, what is needed is a system and method that addresses the deficiencies of conventional point-supported and conventional construction frameworks.

SUMMARY OF THE INVENTION

In various representative aspects, the present invention provides a system and method for the assembly and support of construction sections. Exemplary features generally include a guide track disposed within a mullion and a fitting that is suitably adapted for supporting a construction section, where the fitting is configured to hold and retain a construction section once the fitting is engaged within the guide track of the mullion.

Advantages of the present invention will be set forth in the Detailed Description which follows and may be apparent from the Detailed Description or may be learned by practice of exemplary embodiments of the invention. Still other advantages of the invention may be realized by means of any of the instrumentalities, methods or combinations particularly pointed out in the claims.

BRIEF DESCRIPTION OF THE DRAWINGS

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent in light of certain exemplary embodiments recited in the detailed description, wherein:

Elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms "first", "second", and the like herein, if any, are used inter alia for distinguishing between similar elements and not necessarily for describing a sequential or chronological order. Moreover, the terms "front", "back", "top", "bottom", "over", "under", "forward", "aft", and the like in the Description and/or in the claims, if any, are generally employed for descriptive purposes and not necessarily for comprehensively describing exclusive relative position. Any of the preceding terms so used may be interchanged under appropriate circumstances such that various embodiments of the invention described herein, for example, may be capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventor's conception of the best mode, and are not intended to limit the scope, applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

Various representative implementations of the present invention may be applied to any system for construction. Certain representative implementations may include systems and methods tailored to a specific type of construction, such as point-supported glass wall systems. A detailed description of an exemplary application, namely a construction system for point-supported glass-paned walls, is provided as a specific enabling disclosure that may be generalized to any application of the disclosed systems, devices and methods for construction in accordance with various embodiments of the present invention.

Figure 1:
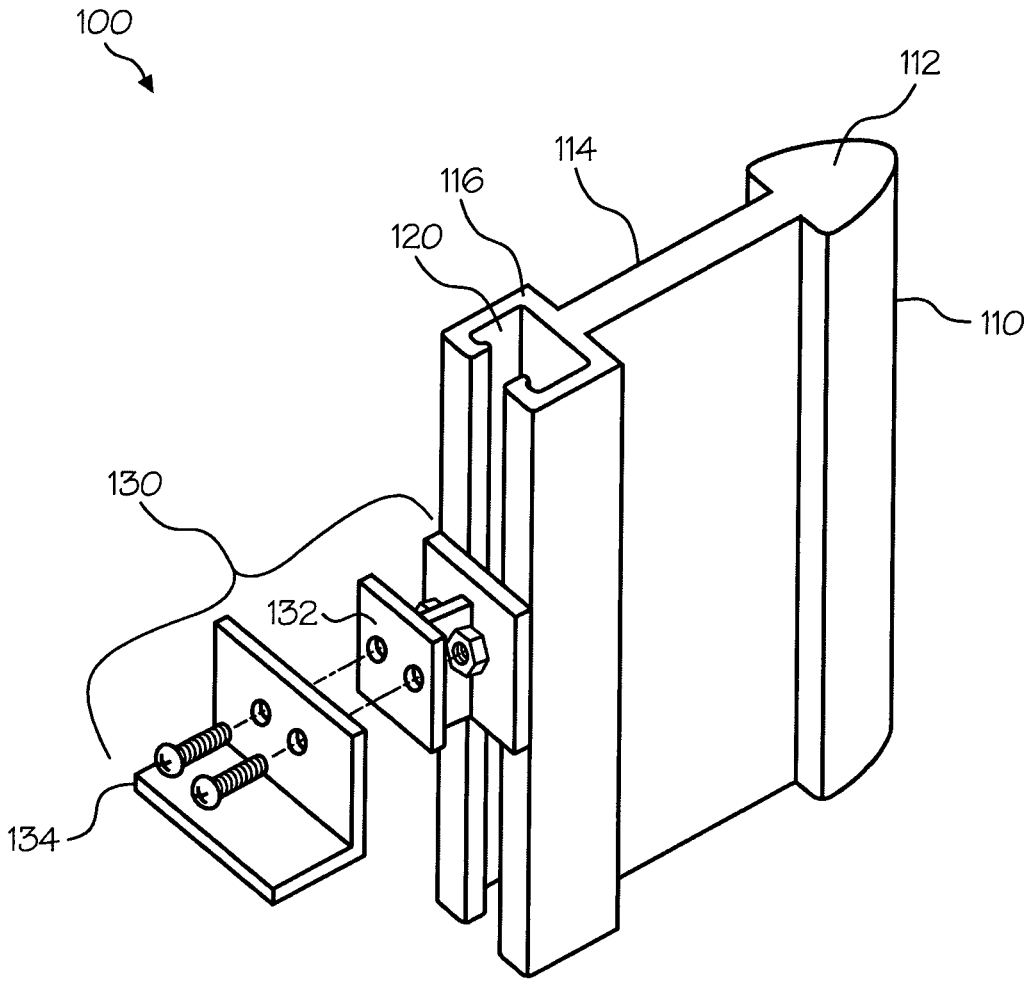
FIG. 1 representatively illustrates a three-quarter isometric view of a fitting attached to a mullion in accordance with an exemplary embodiment of the present invention.

As generally depicted in FIG. 1, a representative embodiment of an exemplary construction system 100 generally comprises a mullion 110 having a guide track 120 disposed along at least one dimension of mullion 110. Guide track 120 may be disposed along a substantially linear length of mullion 110 and may be suitably adapted for adjustable engagement with fitting 130. Fitting 130 may be adjusted along the guide track 120 and substantially fixed in place at any point along guide track 120. Fitting 130 may be suitably configured to support any type of construction section, such as a pane of glass.

Mullion 110 is generally configured for engagement with fitting 130 and provides support for a construction section held in place by fitting 130. Mullion 110 may comprise any material, such as, for example: metal; polymer; graphite; alloy; wood; composites and/or any other types of material, whether now known, hereafter discovered or otherwise subsequently described in the art. Mullion 110 may also comprise any structural or design features that may be employed to allow for the attachment of fitting(s) 130 for providing support and/or retention of construction sections. Construction sections may comprise, for example: wood; ceramic; glass; polymer sheeting; bullet-proof glass; synthetic paneling and/or any other type of material, whether now known, hereafter discovered or otherwise subsequently described in the art.

Mullion 110 may be fabricated using any method of manufacture known in the art and may include any number of suitable materials, such as aluminum, steel, graphite, composite and/or the like. In an exemplary embodiment, for example, mullion 110 may be fabricated from forged or extruded aluminum. In another embodiment, according to various representative aspects of the present invention, mullion 110 may comprise a steel rod configured for attachment to a fitting suitably adapted to support a shelf plate. In such an embodiment, the rod may provide anchoring support of the shelf plate, and the shelf plate may be configured to at least partially support, for example, panes of glass at the corner edges of a glass wall.

Mullion 110 comprises a first end 112 that may be positioned towards the interior of a structure being constructed. A connecting projection 114 may be provided to join the first end 112 with a second end 116 of mullion 110. Mullion 110 may also comprise a guide channel 120 substantially disposed on second end 116. Guide channel 120 may be positioned, for example, towards the exterior of a structure being constructed using the disclosed systems and methods, and may provide suitable anchor points for attachment of fitting (s) 130 that subsequently operate to retain and support a construction section. In such an exemplary embodiment, the depicted structure of mullion 110 allows it to support the weight of the construction section held by fitting 130. Additionally, mullion 110 may permit translational or rotational motion in response to environmental effects, such as wind, rain and/or thermal expansion or contraction.

Figure 2:
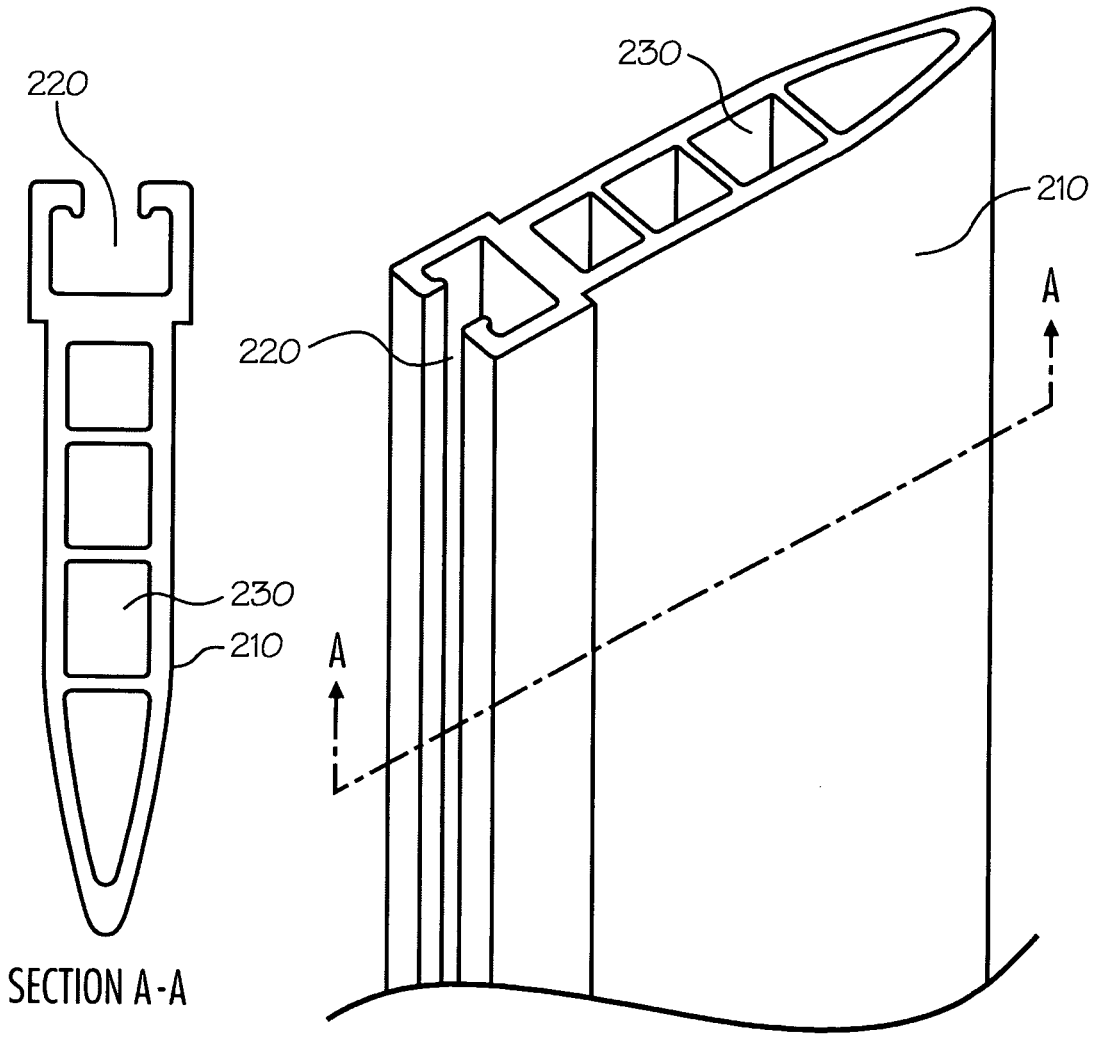
FIG. 2 representatively illustrates top cross-sectional and three-quarter isometric views of a mullion in accordance with an exemplary embodiment of the present invention.

Referring now to FIG. 2, mullion 210 generally comprises a structure having one or more void cavities 230 and a guide channel 220. Cavity 230 may be of any volume or shape and may be disposed within any part of mullion 210. For example, mullion 210 may comprise a plurality of cavities with intervening structures between the void cavities, for example, in order to increase the load bearing strength of mullion 210.

Figure 3:
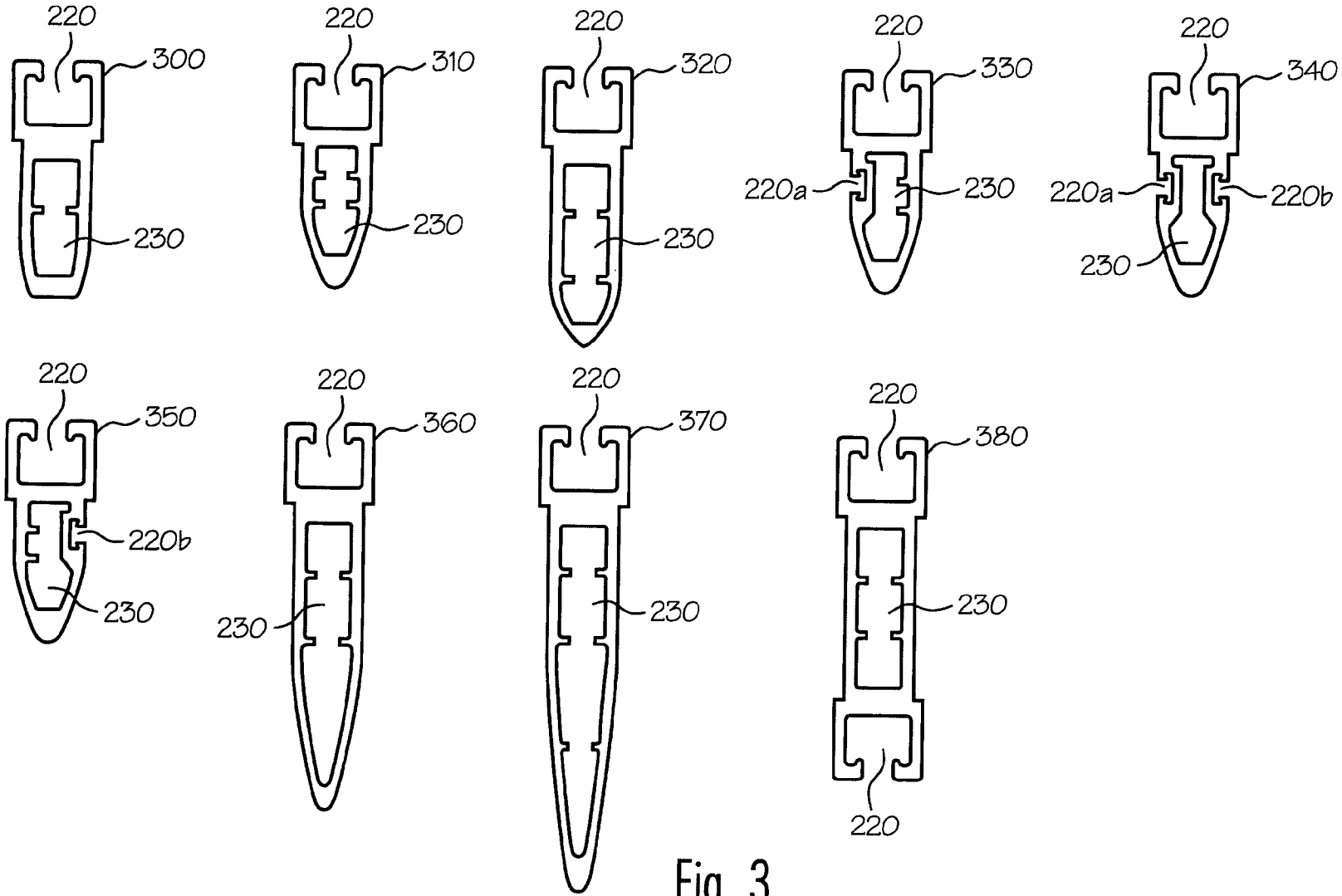
FIG. 3 representatively illustrates top cross-sectional views of various mullion embodiments in accordance with exemplary aspects of the present invention.

Alternatively, conjunctively or sequentially, referring now to FIG. 3, a substantially unitary cavity 210 (such as represented in the depicted exemplary embodiments 300, 310, 320, 330, 340, 350, 360, 370, 380) may be formed at least partially along the top cross-sectional face of a mullion, for example, to reduce weight and/or material cost, as well as to provide the mullion with the ability to react to forces, such as expansion or contraction in response to thermal variations. Mullions 300, 310, 320, 330, 340, 350, 360, 370, 380 may also be configured with one or more variously disposed guide channels 220, 220*a*, 220*b*.

Mullion 110 may interface with or be joined to other mullions in any suitable manner. Mullion 110 may connect with any suitable structures, systems and devices in any suitable manner to achieve any particular purpose. Mullion 110, in accordance with various aspects of the present invention, may be suitably configured for attachment to a surface such as a floor, wall and/or the like. Mullion 110 may be attached to any suitable surface in any suitable manner, and may be configured to support any structure, system, device or architectural element in any suitable manner. For example, in an exemplary embodiment of the present invention, the structure of mullion 110 may comprise a guide channel 120 that operates inter alia to provide attachment and support for panes of glass. Mullion 110 may be adapted to include any other suitable features, such as weep holes to allow moisture to drain away from the guide track 120 of mullion 110, or any other design features whether now known or hereafter described in the construction art.

Figure 4:
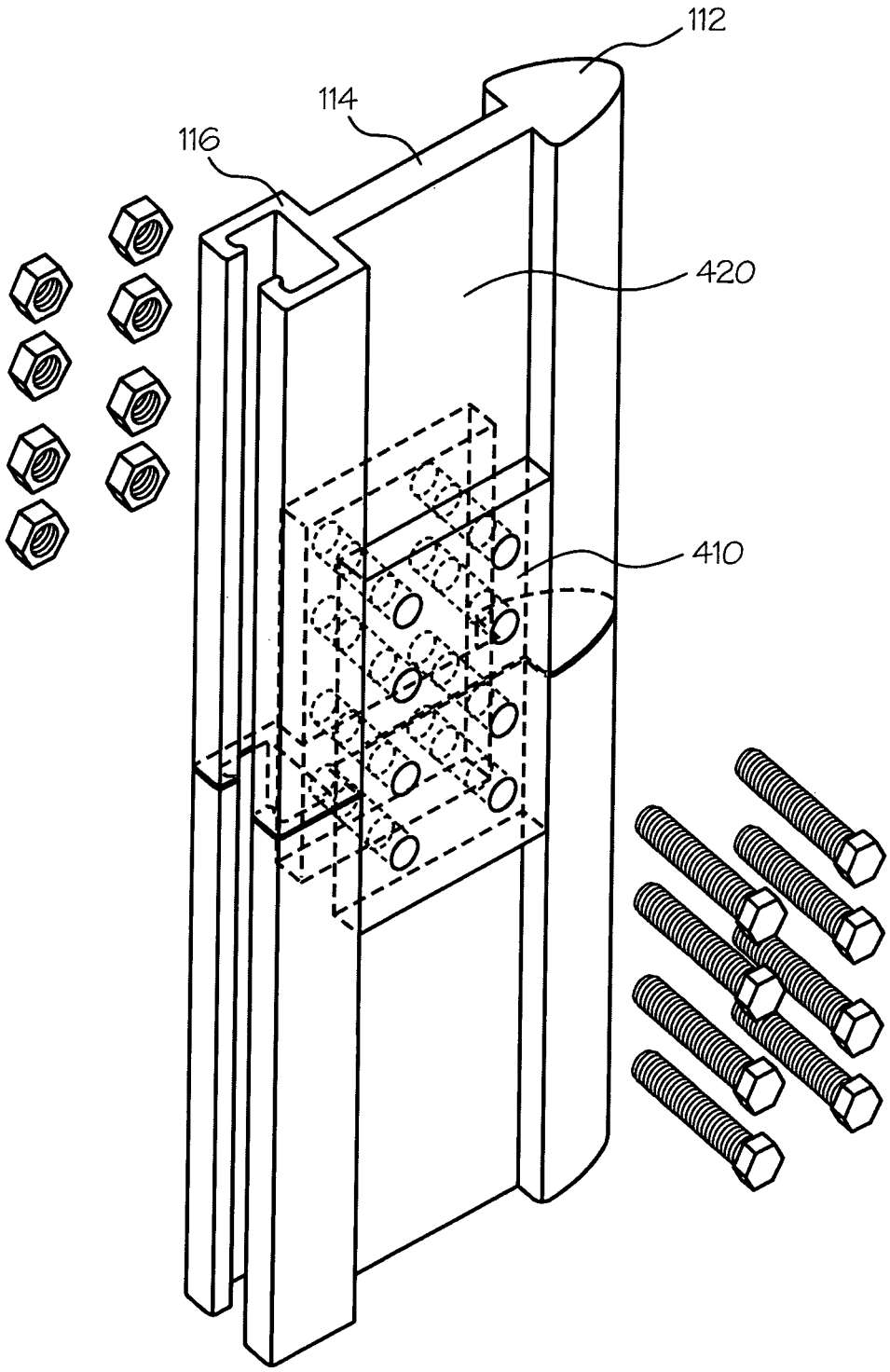
FIG. 4 representatively illustrates a three-quarter isometric view of a mullion splice configuration in accordance with an exemplary embodiment of the present invention.

In another exemplary embodiment, referring now to FIG. 4, a plurality of mullions may be connected using a splice plate 410. Splice plate 410 may be generally configured to permit the attachment of two or more mullions in any suitable manner, such as for example, with the use of nuts and bolts as generally depicted in FIG. 4. Splice plate 410 may comprise any suitable size, shape, configuration, geometry and/or symmetry. In an exemplary embodiment in accordance with the present invention, splice plate 410 may be configured to conform to the recessed area 420 disposed between the first end 112 and the second end of the mullion. Spliced plate 410 may be disposed or otherwise configured for disposal substantially internal to the mullion. Splice plate 410 may be adapted to provide attachment to the connecting projection 114 of the mullions to hold them together.

Figure 5:
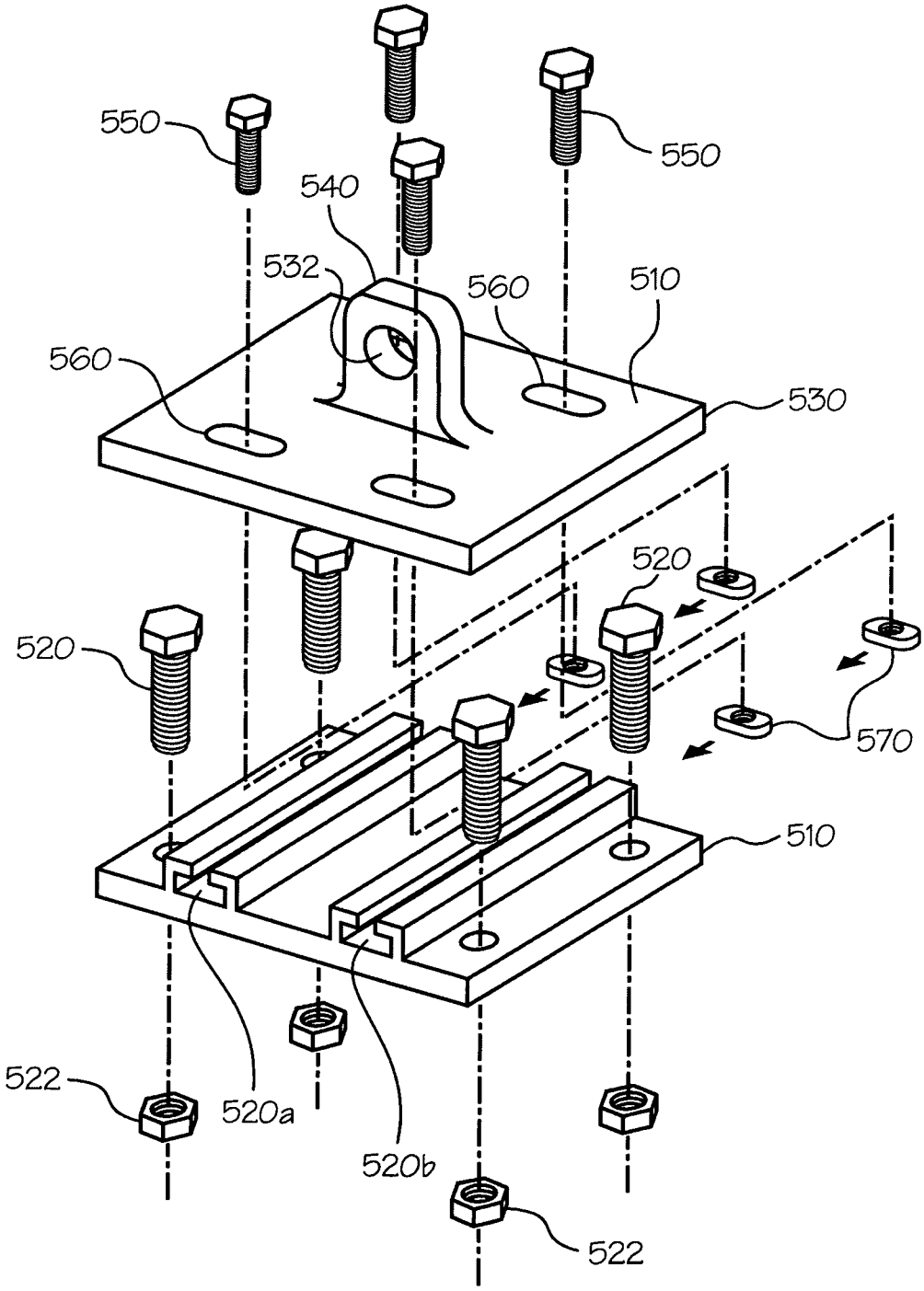
FIG. 5 representatively illustrates a three-quarter isometric view of a dual guide channel anchor bracket and associated fitting in accordance with an exemplary embodiment of the present invention.

In another exemplary embodiment, referring now to FIG. 5, anchor plate 510, according to various representative aspects of the present invention, may include two or more guide tracks 520*a*, 520*b*. Anchor plate 510 may be configured to interface with plate fitting 530, which may comprise an anchor plate assembly suitably adapted to support any type of structure or design element (e.g., a construction section and/or the base of a mullion). Plate fitting 530 may include a substantially vertical plate 540 having a hole 532 disposed therethrough, which may operate as a mounting feature for securing structural attachment(s), such as in the case of using a bolt to attach a structural element to vertical plate 540. Anchor plate 510 may be suitably connected to any surface in any manner, whether now known or otherwise hereafter described in the art. For example, anchor plate 510 may be attached to a floor using bolts 520. The position of plate fitting 530 may be adjusted along the length of guide tracks 520*a*, 520*b* as well as slots 560 and attached to anchor plate 510 using bolts 550 and clamp nuts 570.

Figure 6:
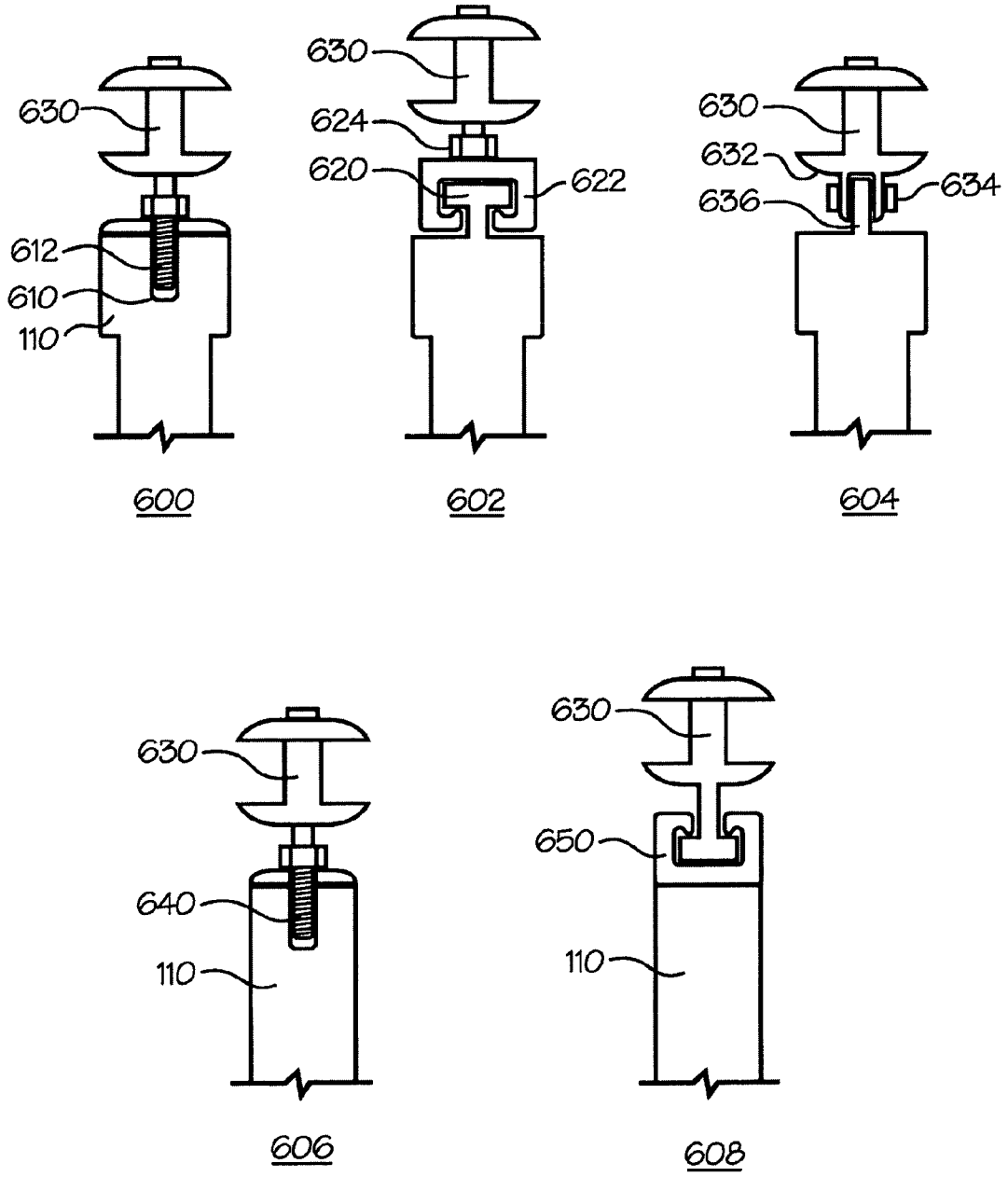
FIG. 6 representatively illustrates side cross-sectional views of a plurality of fitting engagement mechanisms in accordance with various exemplary embodiments of the present invention.

In general, guide channels generally enable the fittings to be connected to the mullion. The guide channels may be fabricated from any material, whether now known or otherwise hereafter described in the art. Guide tracks may comprise any shape, size or configuration and may include any number of sub-systems and/or design features to achieve any particular purpose. For example, in the embodiment generally depicted in FIG. 1, guide track 120 may comprise a lip-rail channel integrated within the structure of mullion 110. Additionally, mullion 110 may comprise multiple guide tracks 120 suitably adapted for any particular purposes. As shown in the exemplary embodiment illustrated in FIG. 5, for example, anchor plate 510 may include multiple guide channels 520*a*, 520*b*. In an alternative, conjunctive or sequential exemplary embodiment, referring now to FIG. 6, guide track 120 may comprise a groove or raceway 610 formed substantially within the interior of mullion 110. (See, for example, embodiment 600). Groove 610 may be configured to suitably support fitting 630 in any suitable manner, such as in the case of using a screw 612 to anchor fitting 630 in groove 610. In another exemplary embodiment 602, the guide track may comprise an extruded rail structure 620 (as compared with, for example, an intruded rail structure 650). In this exemplary embodiment, fitting 630 may include a jacket structure 622 that engages and fits around rail structure 620. Fitting 630 may be generally attached to rail structure 620 in any suitable manner, such as by using a set screw 624. In an alternative exemplary embodiment 604, in accordance with various aspects of the present invention, the guide track may comprise a fin structure 636. Fin 636 may be configured to support fitting 630 in any suitable manner, such as by adapting fitting 630 to retain and support a pinch plate 632 held to fin structure 636 using bolt 634, for example. The Guide track may include any suitable structure, such as a fastener 640 that holds fitting 630 to mullion 110. (See embodiment 606). The Guide track in various other embodiments may be attached to mullion 110 in any manner, whether now known or otherwise hereafter described in the art. For example, the guide track may comprise an intruded rail 650 attached to mullion 110, which may be suitably adapted to retain and support fitting 630 as shown in exemplary embodiment 608.

Fitting 630 may be generally configured for attachment to mullion 110 and may be suitably adapted to retain and support a construction section. Fitting 630 may include any number of sub-systems, structures and/or devices to achieve any particular purpose.

Figure 7:
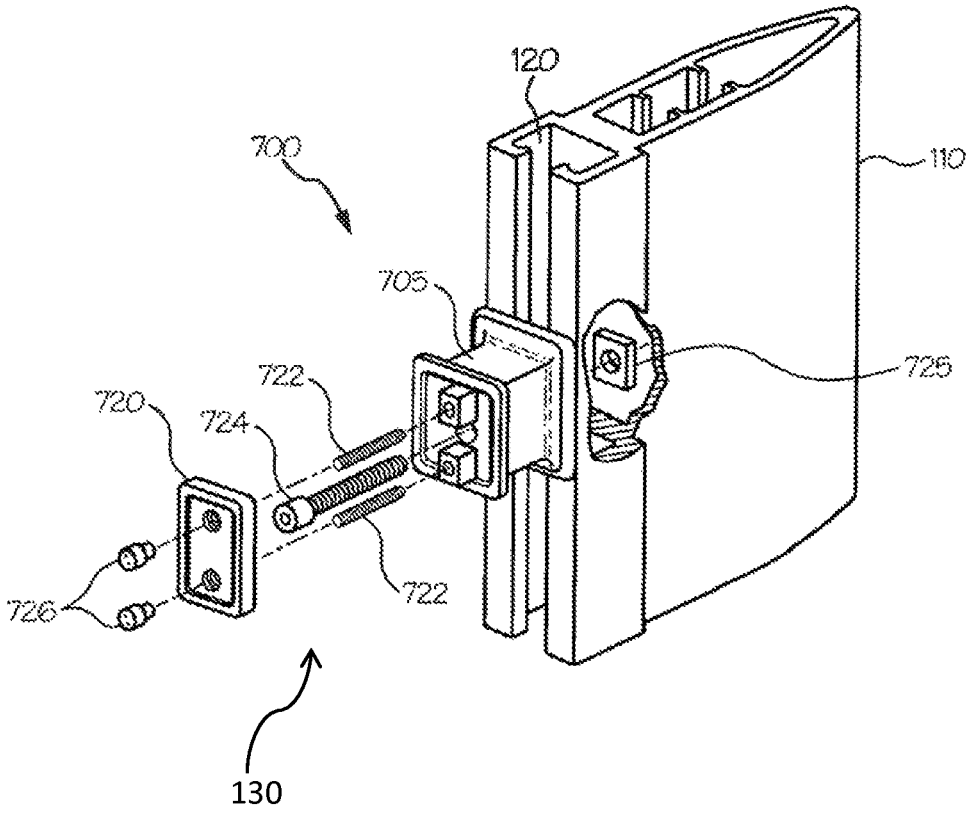
FIG. 7 representatively illustrates a three-quarter isometric view of a pinch-plate fitting that may be attached to the guide track of a mullion in accordance with an exemplary embodiment of the present invention.

In an exemplary embodiment, referring now to FIG. 7, fitting 130 may include a pinch plate sub-system 700 comprising a clamp nut 725 and screw 724 configured to attach the inner fitting 705 to the guide track 120 of mullion 110. A construction section may be retained and supported, for example, between the cap 720 and the inner fitting 705 using studs 722, cap nuts 726, screw 724 and the clamp nut 725 to provide (once assembled) suitable pressure against a point-supported face of a construction section (e.g., glass panel).

Figure 8:
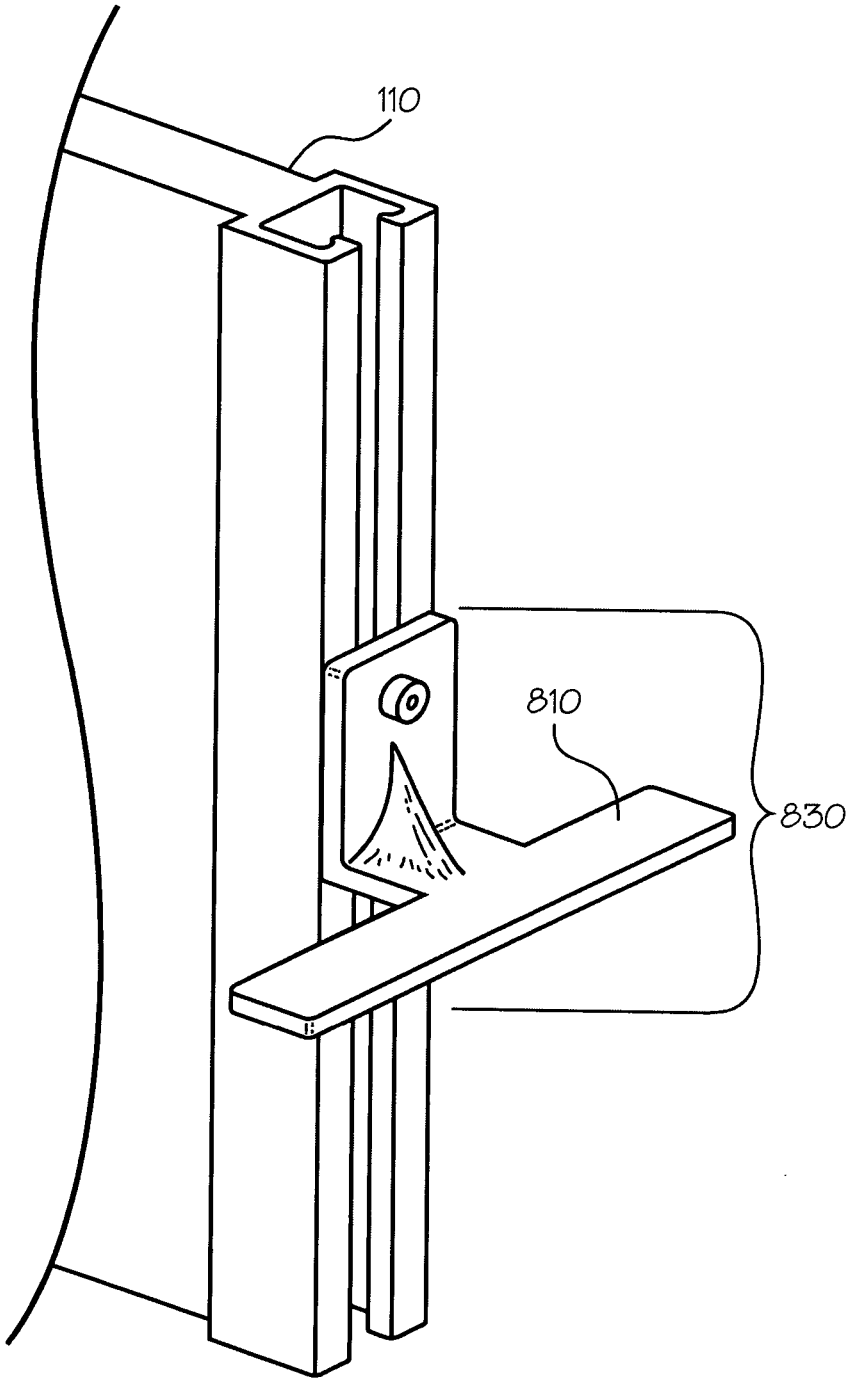
FIG. 8 representatively illustrates a three-quarter isometric view of a shelf fitting attached to the guide track of a mullion in accordance with an exemplary embodiment of the present invention.
Figure 9:
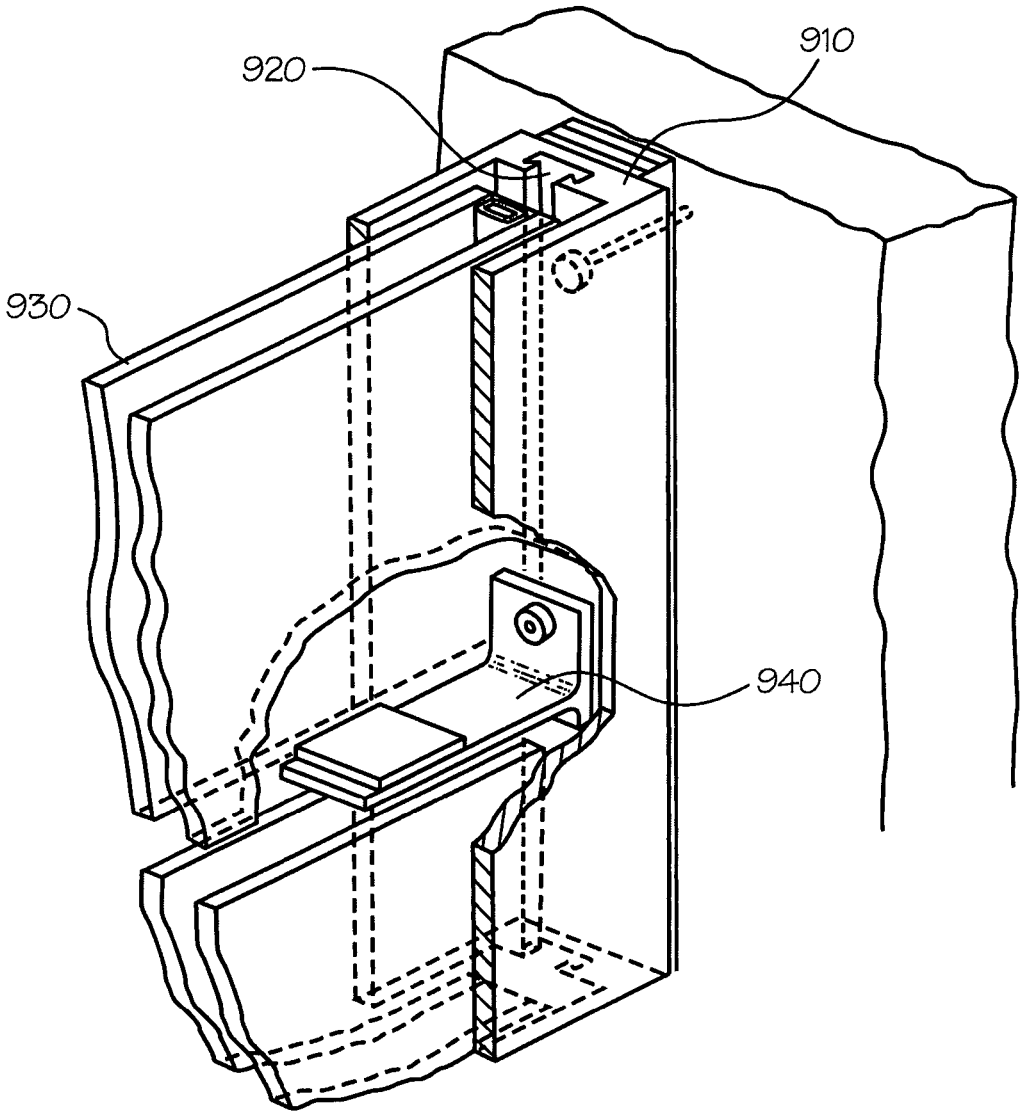
FIG. 9 representatively illustrates a three-quarter isometric view of a jamb channel fitting attached to a guide track integrated into the jamb channel in accordance with an exemplary embodiment of the present invention.

Fitting 130 may be adapted to support a construction section in any manner, whether now known or hereafter described in the art. For example, referring now to FIG. 8, fitting 830 may include a shelf feature 810. Shelf 810 may be configured to support a construction section in any manner, such as via bearing the weight of a pane of glass resting on top of shelf 810. Alternatively or conjunctively, shelf 810 may be suitably adapted to run substantially parallel to mullion 110 in order to provide horizontal support for a construction section. Similarly, fitting 830 may be configured in any manner to hold a construction section at any angle. For example, fitting 130/830 may include angled and/or curved structures to allow a construction section to be supported by the fitting at various angles and positions with respect to orientation of the mullion 110. Shelf 810 may comprise any configuration that may be employed for any particular purpose, whether now known or otherwise hereafter described in the art. For example, referring now to FIG. 9, the shelf structure may include a jamb shelf 940 configured for attachment to the guide channel 920 of channel/mullion 910. In this case, jamb shelf 940 may be adapted to support and retain, for example, a pane of glass 930.

Fittings in accordance with various representative embodiments of the present invention may include any structure, sub-system and/or device suitably configured to support a construction section in any manner for any particular purpose, whether now known or otherwise hereafter described in the art. For example, referring again to FIG. 1, fitting 130 may include a base 132 and a shelf plate 134, where the shelf plate 134 is substantially removably attachable to the base 132. In such an embodiment, fitting base 132 may attach to any number of modular systems, devices and/or fasteners that are suitably adapted for holding construction sections.

Figure 10:
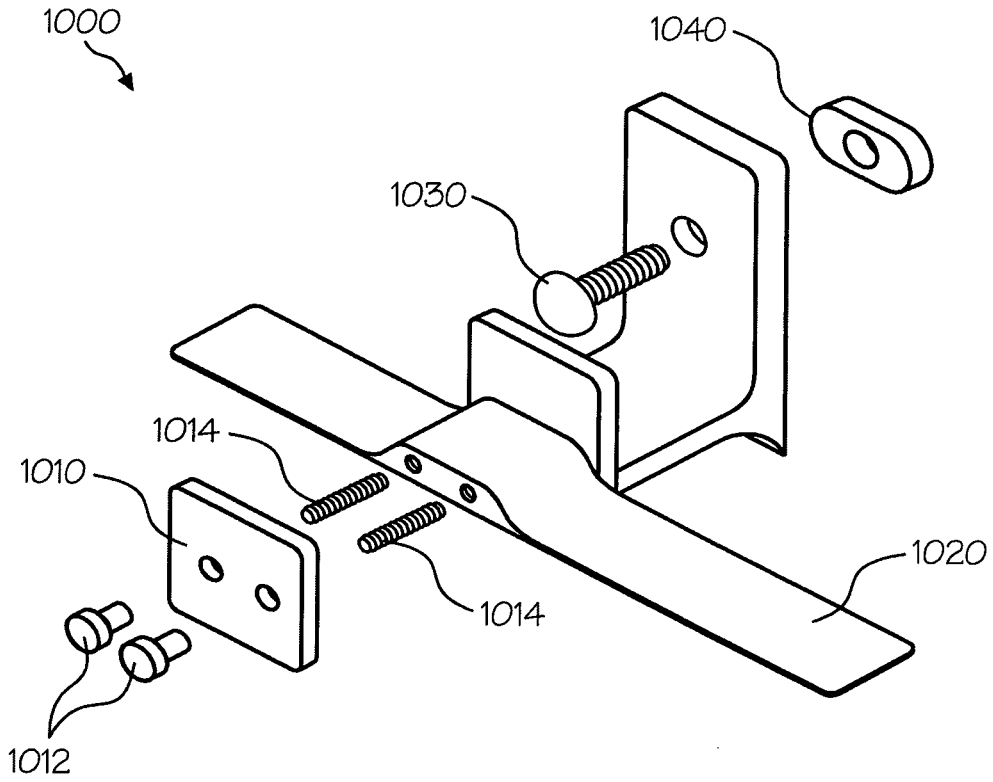
FIG. 10 representatively illustrates a three-quarter isometric view of a pinch-plate, shelf-mount combination fitting in accordance with an exemplary embodiment of the present invention.

Referring now to FIG. 10, an exemplary fitting according to various aspects of the present invention may comprise a combination pinch plate and shelf fitting 1000 having a pinch plate 1010, cap nuts 1012, studs 1014 and a shelf plate 1020. Shelf plate 1020 may be suitably adapted to support a construction section substantially vertically, while pinch plate 1010 may be configured to support a construction section in place using, for example, cap nuts 1012 and studs 1014. Shelf fitting 1000 may be suitably configured for attachment to mullion 110, for example, using bolt 1030 and channel clamp nut 1040.

Figure 11:
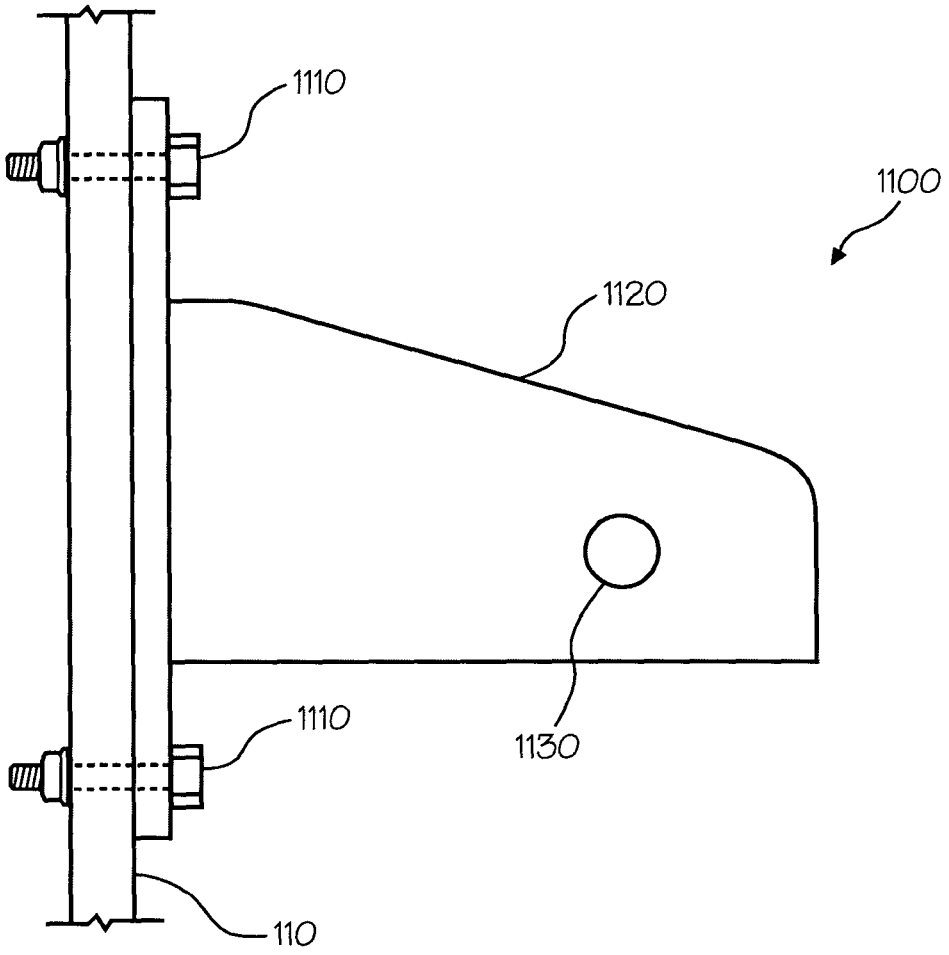
FIG. 11 representatively illustrates a side cross-sectional view of a hanger fitting in accordance with an exemplary embodiment of the present invention.

In another exemplary embodiment in accordance with various aspects of the present invention (referring now to FIG. 11), fitting 130 may comprise a hanger mount assembly 1100. Hanger mount 1100 may include a plate 1120 having a support hole 1130 disposed therethrough. Hanger mount 1100 may be suitably configured for attachment to mullion 110 via bolts 1110 and nuts 1115. Hanger mount 1100 may be further adapted to support any sub-system, structure and/or construction section in any manner, whether now known or otherwise hereafter described in the art. For example, a plurality of hanger mounts 1100 may be used to support a canopy by connecting hanger mounts 1100 on a canopy to hanger mounts 1100 on a glass wall, for example, using cables. Hanger mount 1100 may include any number of structures and/or sub-systems in any configuration. For example, hanger mount 1100 may have a plurality of support holes 1130 that anchor, for example, an awning or sun shade extension having louvered blades. Similarly, hanger mount 1100 may support a canopy blade extension.

Figure 12:
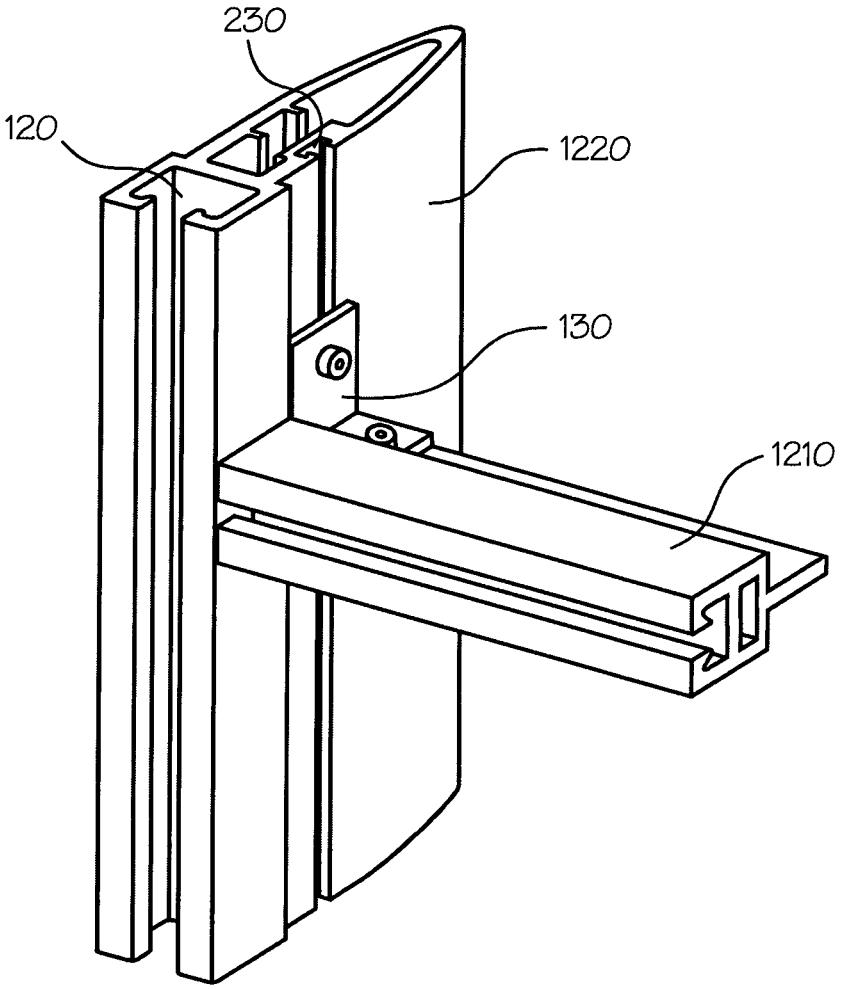
FIG. 12 representatively illustrates a three-quarter isometric view of two mullions attached in accordance with an exemplary embodiment of the present invention.
Figure 13:
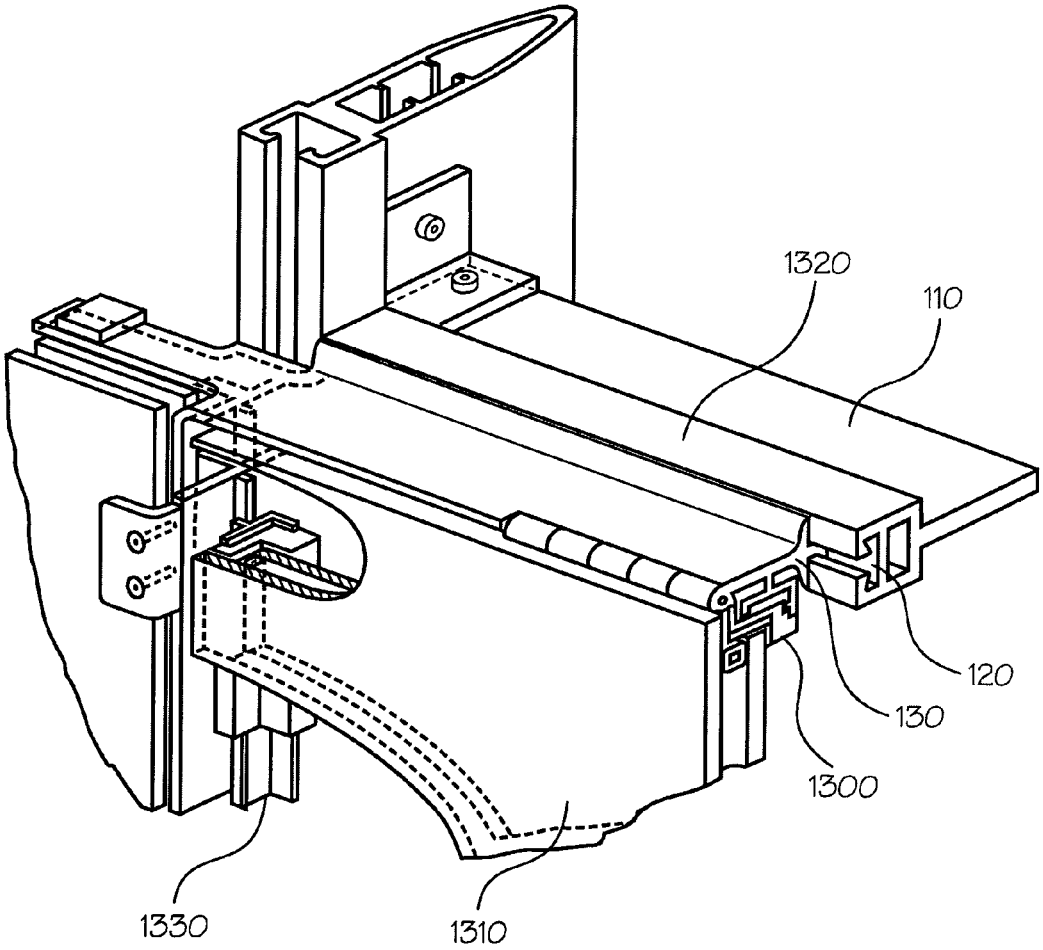
FIG. 13 representatively illustrates a three-quarter isometric view of a door/window hinge fitting having a movable assembly for attachment of a window to the guide track of a mullion in accordance with an exemplary embodiment of the present invention.

Fitting 130 may interface with any structures, sub-systems and/or devices to achieve any particular purpose. Referring now to FIG. 12, a horizontally disposed mullion 1210 may be suitably attached to the guide channel 230 of a vertically disposed mullion 1220 using a fitting 130 to form a horizontal support. Any other suitable structure, system and/or device may also interface with guide channel 230 in any suitable manner or configuration. In another embodiment, for example, referring now to FIG. 13, fitting 130 includes a hinge assembly 1300. Hinge assembly 1300 may be configured to suitably retain and support a construction section, such as a window or door 1310 while allowing the window or door 1310 to open and close. In such an embodiment, head extrusion 1320 may be adapted to attach to the mullion thereby permitting the window/door 1310 to close against edge frame 1330.

Figure 14:
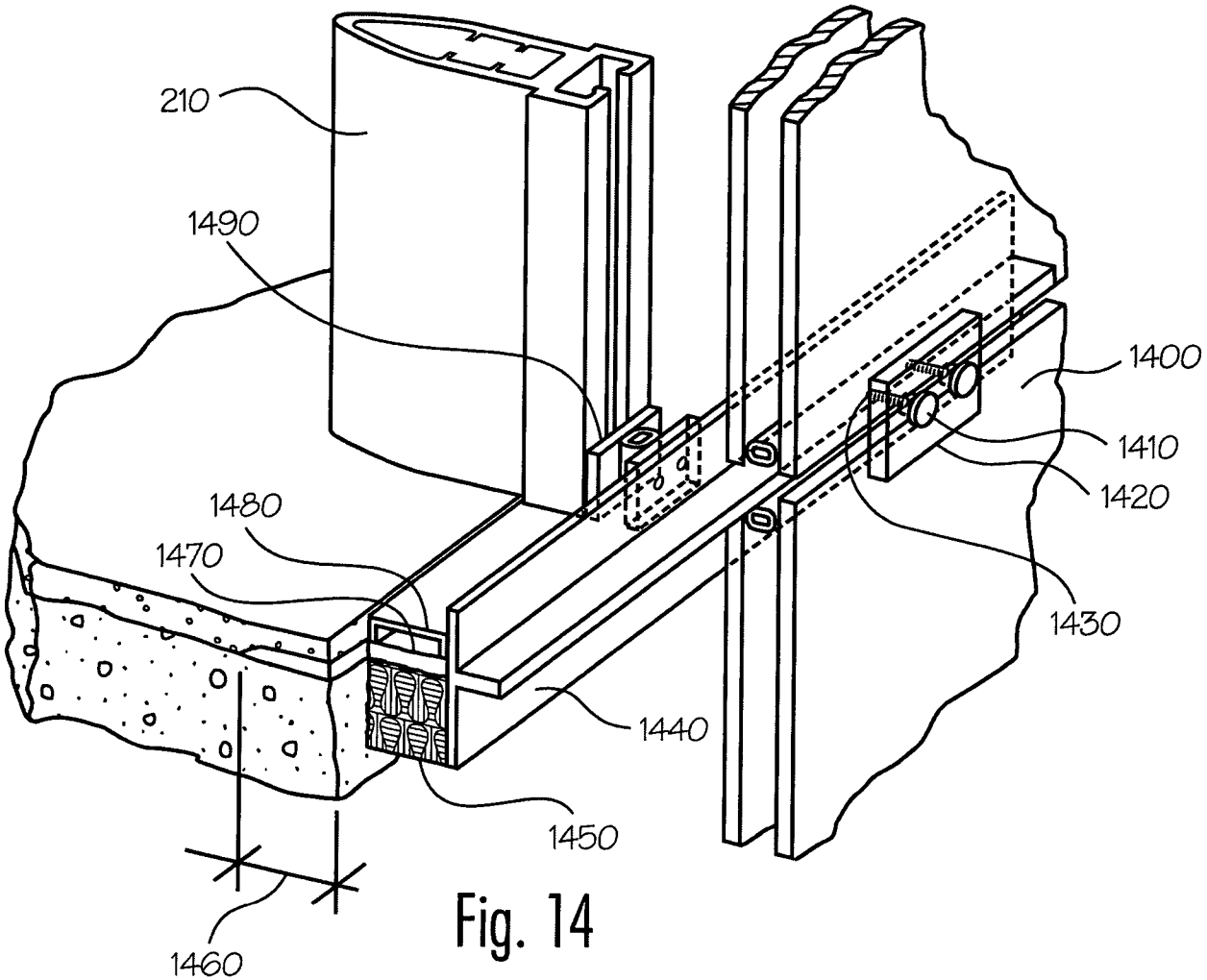
FIG. 14 representatively illustrates a three-quarter isometric view of a fire safe construction design assembly in accordance with an exemplary embodiment of the present invention.

Referring now to FIG. 14, glass pane 1400 may be retained and supported relative to guide track 1440, mullion 210 and fitting 1490 via operational engagement of cap nut 1410 with pinch plate 1420 and threaded stud 1430. For safety applications, guide track 1440 may be packed with, for example, mineral wool batting 1450 in order to reduce the risk of fire. The fire proofing material 1450 (e.g., mineral wool batting) may comprise additional fill material 1470 that intrudes into the main structural support material as representatively depicted in the overlap 1460 shown in FIG. 14. The fill material 1470 and fire proofing material 1450 may thereafter be enclosed with, for example, a metal trim closure 1480 to retain the materials or otherwise prevent them from being exposed to the external environment.

The disclosed construction system may also be suitably adapted to provide a dual or plural glass panel. In a representative embodiment, a first glass panel may be disposed substantially exterior to the mullion and a second (or subsequent) glass panel may be disposed substantially interior to the mullion with an air-gap therebetween. This would provide inter alia improved acoustic dampening and energy efficiency.

The disclosed construction system may also be suitably adapted to provide a hurricane resistant glazing system attached to the front of the mullion. In this configuration, fitting 130 may be modified to provide a hook structure suitably configured to support a framed glass panel—for example, with a relatively small aluminum edge frame of the panel continuously supporting the glass construction section. The assembled panel would subsequently offer "point-supported" retention at the hook fittings. Such a system would be particularly well adapted to satisfy large projectile impact requirements of building materials in, for example, hurricane conditions.

In a construction system according to various aspects of the present invention, mullions may be attached to the structure of a building to provide a framework for supporting construction sections. Suitably configured fittings may be attached to the mullions to provide point-supported or continuously supported retention of construction sections. Construction systems in accordance with various exemplary embodiments of the present invention may be used to build any type of structure, whether now known or hereafter described in the art, such as a point-supported glass wall, for example. The construction system may also be used to achieve various aesthetic benefits. For example, the panes of glass used to form a glass wall will generally be displaced away from the mullions, making it more difficult to see the mullions from an exteriorly disposed vantage point. Additionally, construction systems in accordance with the present invention may be used to achieve any structural benefit, whether now known or hereafter described in the art, such as the ability to construct a multi-story point-supported glass wall system using substantially vertically-aligned mullions without the need for horizontally-aligned mullions.

Constructs (i.e., construction designs) that may be realized via implementation of various embodiments of the present invention shall be understood to comprise anything that may be at least partially assembled from at least one or more component parts, such as, for example: a window; a wall; a partition; a frame; a panel; a covering; a dome; a door; a display case; a display wall; a display frame; a cubicle; a presentation display; a booth; an enclosure; a temporary habitat; a mobile home; a video device array; various architectural construction elements; and/or the like.

A 'construction section' shall be understood to comprise any component part of a construct surface, such as, for example, a pane of glass, a panel of wood, a sheet of drywall, a graphite board, Plexiglas, Lucite, a video device element, etc. Furthermore, a construction section may comprise any two-dimensional (e.g., substantially planar) or three-dimensional (e.g., polyhedral, spherical, hemispherical, elliptical, parabolic, etc.) geometry and/or any combination thereof.

In the foregoing specification, the invention has been described with reference to specific exemplary embodiments; however, it will be appreciated that various modifications and changes may be made without departing from the scope of the present invention as set forth in the claims below. The specification and Figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

I claim:

1. A point-supported construction system for a glass panel, comprising:

a mullion comprising at least one guide track disposed at least partially along at least one dimension of the mullion; and a fitting adjustably engaged to the guide track. comprising:

an inner fitting. comprising:

an exterior piece positioned outside the guide track;

an interior piece positioned inside the guide track; and a first fastener coupling the exterior piece to the interior piece;

wherein a portion of the guide track is disposed between the exterior piece and the interior piece;

an outer fitting; and a second fastener coupling the outer fitting to the inner fitting;

wherein the fitting is selectively adjustable along the guide track while engaged to the guide track; the inner fitting and the outer fitting are configured to provide support for a portion of the glass panel at a distance from the mullion; and a portion of the glass panel is received between the inner fitting and the outer fitting.

2. The construction system of claim 1, wherein said mullion dimension is at least one of substantially linear and substantially curvilinear.

3. The construction system of claim 1, wherein said fitting is adapted to provide support for a portion of the glass panel using at least one of a pinch plate, a hanger extension and a shelf.

4. The construction system of claim 1, further comprising a second mullion, wherein the second mullion is configured for attachment to the guide track.

5. The construction system of claim 1, wherein the mullion further comprises an interiorly disposed void volume and the guide track is at least partially located within the void volume of the mullion.

6. The construction system of claim 1, wherein the mullion further comprises an exteriorly disposed surface and the guide track is at least partially located on the exterior surface of the mullion.

7. The construction system of claim 1, further comprising at least one of a plurality of mullions and a plurality of substantially interconnected mullions.

8. The construction system of claim 7, wherein said plurality of mullions are connected together by at least one splice plate.

9. A construction method for providing point-support for a glass panel,comprising:

providing a mullion having at least one guide track disposed at least partially along at least one dimension of the mullion; and providing a fitting adjustably engaged to the guide track, the fitting comprising:

an interior fitting, comprising:

an exterior piece positioned outside the guide track;

an interior piece positioned inside the guide track; and a first fastener coupling the exterior piece to the interior piece; wherein a portion of the guide track is disposed between the exterior piece and the interior piece;

an outer fitting; and a second fastener coupling the outer fitting to the inner fitting;

wherein the fitting is selectively adjustable along the guide track while engaged to the guide track; the inner fitting and the outer fitting are configured to provide support for a portion of the glass panel at a distance from the mullion; and a portion of the glass panel is received between the inner fitting and the outer fitting.

10. The construction method of claim 9, further comprising the step of positioning the fitting along the guide track.

11. The construction method of claim 9, wherein the fitting comprises at least one of a pinch plate, a hanger extension and a shelf.

12. The construction method of claim 9, further comprising a second mullion, wherein the second mullion is configured for attachment to the guide track.

13. The construction method of claim 9, wherein the mullion includes an interiorly disposed void volume and the guide track is at least partially located within the void volume of the mullion.

14. The construction method of claim 9, wherein the mullion further comprises an exteriorly disposed surface and the guide track is at least partially located on the exterior surface of the mullion.

15. The construction method of claim 9, further comprising the step of providing at least one of a plurality of mullions and a plurality of substantially interconnected mullions.

16. The construction method of claim 15, wherein the mullions are connected together by at least one splice plate.

17. An architectural device for supporting building material, comprising:

a mullion having at least one guide track disposed at least partially along at least one dimension of the mullion; and a fitting selectively adjustably engaged to the guide track, comprising:

an inner fitting, comprising:

an exterior piece positioned outside the guide track;

an interior piece positioned inside the guide track; and a first fastener coupling the exterior piece to the. interior piece; wherein a portion of the guide track is received between the interior piece and the exterior piece, an outer fitting; and a second fastener coupling the outer fitting to the inner fitting;

wherein the interior piece and the exterior piece are nonadjustably engaged to the guide track when the first fastener is in a first position and adjustably movable and engaged to the guide track when the first fastener is in a second position; the inner fitting and the outer fitting are configured to provide support for a portion of the building material at a distance from the mullion; and a portion of the building material is received between the inner fitting and the outer fitting.

18. The architectural device of claim 17, wherein: said fitting is adapted to provide support for a portion of the building material using at least one of a pinch plate, a hanger extension and a shelf; and said building material comprises at least one of a substantially transparent material and a substantially opaque material.

19. The architectural device of claim 17, wherein the mullion further comprises an interiorly disposed void volume and the guide track is at least partially located within the void volume of the mullion.

20. The architectural device of claim 17, wherein the mullion further comprises an exteriorly disposed surface and the guide track is at least partially located on the exterior surface of the mullion.

21. The architectural device of claim 17, further comprising at least one of a plurality of mullions and a plurality of substantially interconnected mullions.

22. The architectural device of claim 21, wherein said plurality of mullions are connected together by at least one splice plate.

* * * * *